US005143214A

United States Patent [19]

Freelander et al.

[11] Patent Number: 5,143,214

[45] Date of Patent: Sep. 1, 1992

[54] HANGING GARMENT STORAGE BAG

[75] Inventors: Robert Freelander, Long Beach, Calif.; Nicholas Marzano, New York, N.Y.

[73] Assignee: Richards Homewares, Inc., Long Beach, Calif.

[21] Appl. No.: 806,001

[22] Filed: Dec. 9, 1991

[51] Int. Cl.[5] ..... B65D 85/18

[52] U.S. Cl. ..... 206/287; 190/13 R; 206/290

[58] Field of Search ..... 190/13 R; 206/284, 286, 206/287, 289, 290

[56] References Cited

U.S. PATENT DOCUMENTS

| | | | |
|---|---|---|---|
| 1,706,873 | 3/1929 | Date | 206/287 |
| 2,016,520 | 10/1935 | Short | 206/289 |
| 2,293,625 | 8/1942 | Patch | 206/287 |
| 2,523,682 | 9/1950 | Corwin | 206/287 |
| 2,534,380 | 12/1950 | Schwartzman | 206/287 |
| 2,561,841 | 7/1951 | Cart | 206/287 |
| 2,594,569 | 4/1952 | Levitt | 206/287 |
| 2,643,003 | 6/1953 | Christie | 206/287 |
| 2,645,541 | 7/1953 | Mintz et al. | 206/287 |
| 3,746,151 | 7/1973 | Brophy et al. | 206/287 |
| 4,640,414 | 2/1987 | Mobley et al. | 206/287 |

*Primary Examiner*—Gary E. Elkins
*Attorney, Agent, or Firm*—Charles H. Thomas

[57] ABSTRACT

A hanging wardrobe garment storage bag is provided with a garment support rod that hangs directly from an overhead clothes rod rather than from the frame of the garment bag. The garment bag has a conventional rigid wire frame with an upper portion formed into a rectangular wire loop. The rigid, rectangular loop is suspended from the overhead clothes rod by a frame hook which extends up through a central opening in the top of a flexible garment cover. A linearly extending wire garment rack rod is located below the wire garment bag frame and extends parallel to the overhead clothes rod. A pair of garment rack hooks are secured to the garment rack rod and extend up through openings in the flexible garment cover to hang directly from the clothes rod. The garment rack thereby hangs directly from the clothes rod so that the weight of garments stored within the bag does not bear on the garment bag frame.

14 Claims, 2 Drawing Sheets

HANGING GARMENT STORAGE BAG

BACKGROUND OF THE INVENTION

1. Field of the Invention

The present application relates to an improved wardrobe storage bag for storing hanging garments in closets and elsewhere.

2. Description of the Prior Art Garment storage bags for storing hanging garments in closets and on free standing racks and wardrobe cabinets are widely utilized to preserve the appearance of garments by protecting hanging garments from moth damage and from dust. Conventional garment storage bags are typically constructed of a flexible covering of cloth or plastic that defines an enclosure within which the garments are stored. Many conventional garment bags are often constructed with a framework which serves to hold the garment bag covering away from the garments to at least some extent to preserve the appearance of the garments and to prevent hanging garments from becoming wrinkled with prolonged storage. The framework is often constructed of rigid wires, sometimes formed into rectangular loops or hoops and positioned at the top and at the bottom of the garment bag. The upper portion of the frame is positioned directly beneath the top of the covering with the rectangular wire loop supporting the covering from beneath. The covering then hangs from the upper rectangular loop generally in the shape of a rectangular prism.

A rigid, cross connecting member which serves as a brace typically bisects the rectangular loop at the upper portion of the rigid frame. A plurality of frame supporting hooks are secured to the cross connecting member at the upper portion of the frame and extend up through apertures defined in the flat top of the garment bag covering. The crooks at the upper ends of the frame supporting hooks pass over the top of a clothes rod and are secured at their lower extremities to the cross connecting member of the upper frame portion.

Typically the frame hooks are secured to the wire frame by means of metal fasteners at the bases of the hooks. The metal fasteners are often formed of small rectangular strips of metal sheet stock rolled about the transverse wire frame member into short tubular sleeves. The bases of the frame supporting hooks are typically formed with enlargements, by a mechanical upsetting process so that the lower extremities of the stems or shanks of the hooks are greater in diameter then the wire stock of which the frame supporting hooks are constructed.

The shanks of the frame hooks extend through openings in the small metal strips, which are then wrapped about the transverse cross member of the upper portion of the frame. The metal strips are inelasticaly deformed so that their edges remote from the hooks encircle the cross member and overlap or abut against each other to form tube-like sleeves about the cross connecting member. The tubes at the bases of the hooks can slide along the cross connecting wire member of the upper portion of the frame for positioning at laterally spaced intervals so that the hooks are aligned with openings in the top of the garment bag covering. The upper ends of the hooks terminate in partial loops or crooks which are then inserted through the openings in the cover. The hooks are then maneuvered so that the crooks thereof extend outside of the cover up through these openings from the tubes at their bases. These tubular connectors are disposed about the upper portion of the frame and are located interiorally within the enclosure of the garment bag.

The crooks at the tops of the hooks are located externally of the garment bag enclosure and may be readily hooked over a clothes rod to support the rigid frame. Since the upper portion of the frame supports the top of the garment bag from beneath, the garment bag hangs down outside of the upper portion of the frame, thereby defining an enclosure of a size and shape adapted to receive hanging garments.

The upper portion of the garment bag frame also typically includes a garment hanging rack, which is a length of wire stock that extends generally parallel to and is held a spaced distance beneath the cross connecting member of the frame to which the frame hooks are attached. The garment rack is attached to the cross connecting member at its ends. The garment rack thereby extends in a direction generally parallel to the cross connecting member and is located an inch or so therebeneath so as to provide clearance for clothes hangers.

The clothes hangers, which support garments to be stored, are of the conventional wire or plastic type having hooks at their upper extremities which are suspended from the garment rack located within the enclosure of the covering. The garment rack supports the clothes hangers and is in turn supported by the upper portion of the rigid frame. The weight of the clothing on the clothes hangers is thus borne by the clothes rod through the intermediate structures of the garment rack, the upper portion of the frame, and the frame hooks.

The structure of a conventional garment storage bag of the type described has several significant disadvantages. It is desireable to make the structure of the garment bag frame as light in weight as possible, so as to minimize the overall weight which bears upon the clothes rod of the closet and so as to make the garment storage bag easier to work with. Therefore, the gauge of the wire which is employed in the structure of the garment bag frame is made as narrow as possible, though it must be sufficiently sturdy to support the weight of the garment bag frame. However, because the weight of the clothes within the garment bag is transmitted to the garment bag frame by the connection of the ends of the garment rack which are joined to the frame, a very great weight can be placed upon the garment bag frame, depending upon the weight of the garments to be stored.

When garments of considerable weight are hung from the garment supporting rack that depends from the upper portion of the garment bag frame, the connections of the frame hooks to the frame itself can be overloaded. This causes the tubular connecting sleeves disposed at the bases of the garment frame hooks to be deformed to the extent that they separate from the frame.

The stress to which a conventional garment bag frame will be subjected is very unpredictable. Some users store relatively few garments or relatively light weight garments in a hanging garment bag. In such cases the weight of the garments that is transmitted to the overhead clothes rod through the intermediate garment bag frame is not excessive and the frame will not be damaged during use. On the other hand, the user may choose to store very heavy garments, or a large number of garments in the same hanging garment bag. In such a case the metal stock of which the garment bag frame and hooks are constructed is often inadequate to support the weight of the garments. The frame will become bent and the hooks will pull away from the wire structure of the frame.

SUMMARY OF THE INVENTION

The present invention involves an improved construction for a hanging garment storage bag in which the weight of garments that are to be protected within the bag is not transmitted to the garment bag frame. Thus, the garment bag frame need only be constructed of sufficient sturdiness to support the garment bag cover, since the frame does not bear the weight of the garments. The rigid garment bag frame of the garment bag of the invention can thereby be fabricated from relatively light weight metal stock.

The application of the weight of the garments to the garment bag frame is avoided by providing the garment storage bag of the invention with a separate garment supporting system that does not hang from the garment bag frame, but rather hangs directly from the overhead clothes rod, independently of the frame. This allows the garment bag frame to be constructed of a lighter weight metal stock than has previously been possible. Nevertheless, as in conventional wardrobe garment storage bags, the garments hanging in the garment bag of the invention are completely encapsulated within the surrounding cover, and are not exposed to dust or moth damage.

In one broad aspect the present invention may be considered to be an improvement in a hanging garment bag having a flexible covering that defines an enclosure within which garments are hung from a clothes rod in a closet. As with conventional hanging garment bags, the garment bag of the invention includes a rigid frame disposed within the enclosure and frame hook secured to the rigid frame and projecting upwardly through an aperture in the top of the covering for attachment to the clothes rod. It also includes a garment rack for supporting garments within the enclosure.

According to the improvement of the invention, a pair of garment rack hooks are coupled to the garment rack and project upwardly through the covering and are hooked over the clothes rod. The garment rack is thereby suspended directly from the clothes rod, independently of the rigid frame of the garment bag, but still within the enclosure of the garment bag cover.

In another broad aspect the invention may be considered to be a garment storage bag comprising a flexible covering for enveloping hanging garments therewithin and having a flat top with openings therethrough to allow passage of hooks that engage a clothes rod. A rigid frame is disposed within the covering to support the covering so as to define an enclosure of a predetermined shape. A frame hook is secured to the rigid frame and extends through one of the openings in the cove top to thereby support the frame and the cover from an overhead clothes rod. A garment supporting rod is located within the enclosure and has a pair of garment rod hooks which extend up through other of the openings in the flat top of the covering to hang directly on the clothes rod. In this way the rigid frame and the garment rod are suspended from the clothes rod independently of each other.

The locations of the hooks which are utilized to support both the garment storage bag itself and the garments stored therein are located in the same positions relative to the garment bag cover as are the hooks of conventional garment bags. However, the garment rod hooks differ from hooks employed in conventional hanging garment bags in that they extend downwardly from the overhead clothes rod and bypass the upper portion of the garment bag frame. The garment rod hooks are connected to a sturdy garment rod which is located beneath the upper portion of the garment bag frame.

The garment rod, the garment rod hooks, the garment bag frame and the frame supporting hook of the garment bag of the invention are all preferably fabricated from metal wires, preferably steel wires. However, to produce a hanging garment storage bag of the lightest weight possible and with the greatest economy of manufacture, the garment rod and garment rod hooks are preferably constructed of a thicker gauge of wire than are the garment bag frame and the frame supporting hook. The garment rod and garment rod supporting hooks may be formed of solid steel wire about five thirty-seconds of an inch in diameter. At least portions of the garment bag frame, on the other hand, may be formed of solid steel wire having a smaller diameter, for example one eighth diameter steel wire. This smaller diameter steel wire may be employed as the wire forming the rectangular loop at the top of the hanging garment bag and also the cross connecting bracing member to which the frame supporting hook is connected.

A further advantage of the invention is that the garment rod and garment rod hooks may be separated completely from the garment storage bag. This allows garment storage rods of different weight and durability to be used interchangeably with a single garment storage bag. Thus, the same garment storage bag will accommodate garment rods designed for either heavy duty use or for light weight garments without any change whatsoever in the structure of the garment bag covering and frame. As a result, even if a garment rod should be overloaded to the point where it is bent, such overloading will not adversely effect either the garment bag covering or frame. If a garment rack is overloaded and bent it may merely be discarded and a substitute garment rack, preferably designed to bear clothing of a greater weight, may be substituted in place of the original garment rack. Also, garment bags with the same covering and interior frame may be equipped with garment racks of different strength and packaged for sale as garment bags for normal, lighter weight, or heavy duty use.

To facilitate the insertion and removal of the garment rod and garment rod hooks into the enclosure of the garment bag, the garment rod hooks are preferably secured at swivel connections to the garment rod. The use of swivel connections allows the garment rod hooks to be pivoted relative to the garment rod, so that the hooks can be inserted through the openings in the top of the garment bag cover from the inside of the cover and manipulated without difficulty so that they protrude well above the cover and can be hung directly from a clothes rod in a closet.

The invention may be described with greater clarity and particularity with reference to the accompanying drawings.

DESCRIPTION OF THE EMBODIMENT

Figures 1, 2:
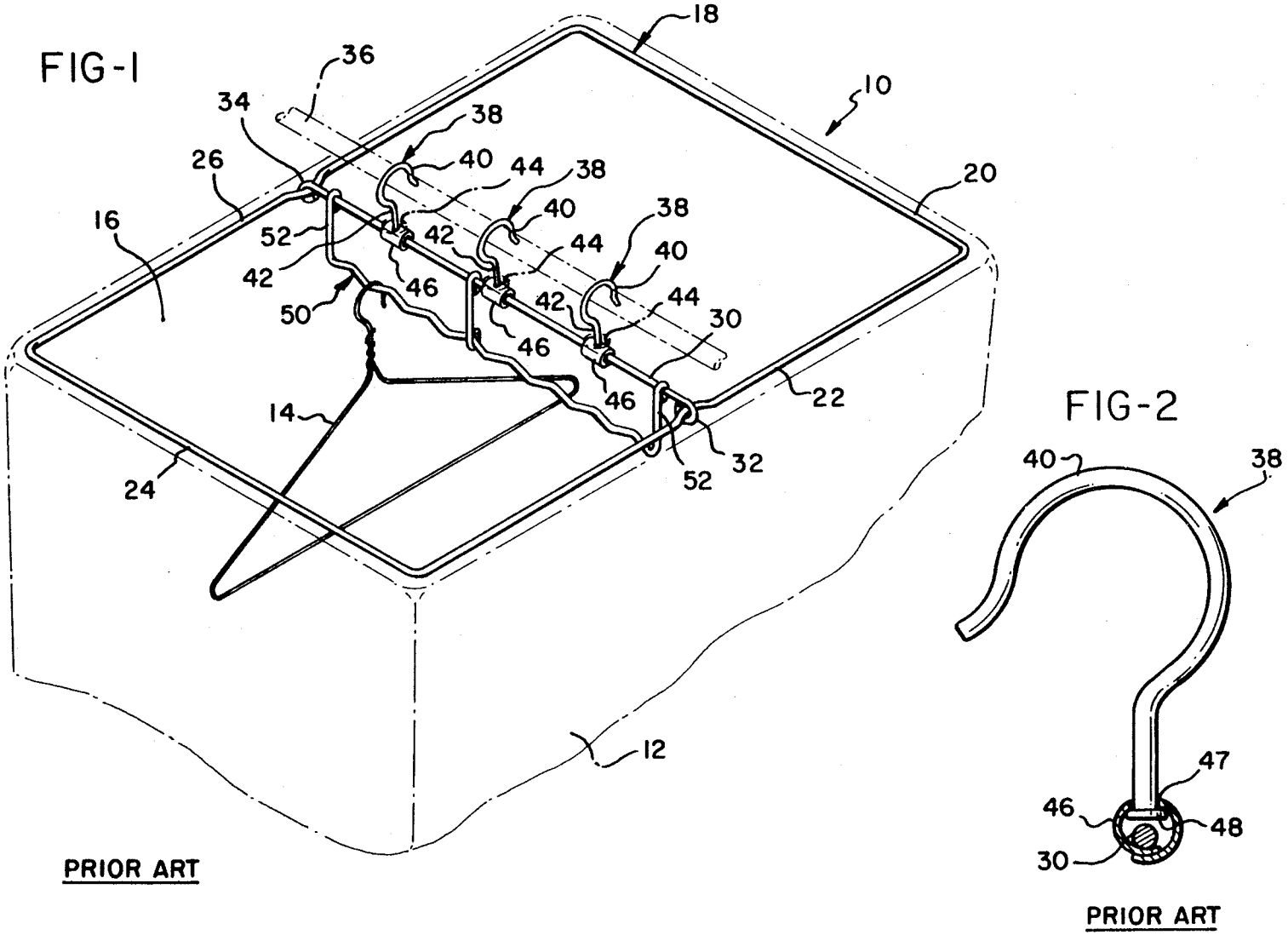
FIG. 1 depicts a typical prior art structure in which the weight of garments within a garment storage bag is transmitted to a clothing rod in a closet through the intermediate structure of the garment bag frame.
FIG. 2 is a sectional detail illustrating the manner in which the garment bag hooks of the conventional garment bag of FIG. 1 are attached to the garment bag frame.

FIG. 1 illustrates a conventional hanging garment bag 10 having a flexible covering 12 for enveloping hanging garments therewithin. Such garments are normally disposed on conventional clothes hangers such as the hanger 14 depicted. The flexible covering 12 may be constructed of a cloth fabric or a transparent or opaque plastic, such as polyvinyl chloride plastic. The covering 12 has a flat top 16 which is generally rectangular in shape and which is sewn along its edges to the upright front, back and sides of the covering 12. An access opening for inserting and removing garments on hangers 14 (not shown) is defined in the front of the covering 12 in a conventional manner. This access opening normally has a vertically oriented zipper or other closure device.

Within the covering 12 the hanging garment bag 10 has a rigid framework including an upper framework portion 18 located just beneath the flat fabric top 16 of the covering 12, and a lower framework portion at the foot of the covering (not shown). The lower portion of the rigid garment bag frame (not shown) is normally merely another length of steel wire formed into an endless rectangular loop to hold the bottom of the walls of the covering 12 apart. The rigid garment bag frame thereby holds the covering 12 generally in the shape of a rectangular prism.

The upper framework portion 18 is formed of an endless loop of rigid wire bent generally into the shape of a rectangle having sides 20, 22, 24 and 26 as illustrated. The wire is typically about ⅛ of an inch in diameter and is formed of steel. The stock from which the upper frame portion 18 is constructed has ends which are in abutment and joined together by welding anywhere about the rectangular outline of the upper frame portion 18. The wire stock forming the upper frame portion 18 thereby is configured into an endless loop of generally rectangular shape having slight inward deflections or undulations at the centers of the longer sides 22 and 26, as illustrated in FIG. 1 The upper frame portion 18 also includes a rigid cross member 30, also formed of ⅛ inch diameter steel wire and bent at its extremities to form eyes which are wrapped about and secured to the central inwardly directed undulations in the frame sides 22 and 26 as illustrated at 32 and 34.

The hanging garment bag 10 is hung from a horizontally disposed clothes rod 36, which normally extends from wall to wall in a closet, but which may also be a rod of a free standing clothes rack or wardrobe cabinet. The garment bag 10 is hung from the clothes rod 36 by means of three separate hooks 38 spaced longitudinally along the length of the cross member 30. The upper extremity of each of the hooks 38 is permanently formed into an arcuate crook 40 which has a curvature such that it can pass over and rest atop the clothes rod 36. The lower extremity of each hook 38 forms shank 42 that projects downwardly and is secured to the cross member 30.

The shanks 42 of the three linearly aligned hooks 38 pass through the flat, rectangular top 16 of the covering 12 through openings 44 therein, as illustrated in FIG. 1. The hooks 38 are joined to the cross member 30 by means of metal sleeves 46 formed of strips of steel about 1/32 of an inch in thickness and about ¾ of an inch in length. These steel strips are formed with laterally opening apertures 47 therein through which the shanks 42 of the hooks 38 project. The lower extremities of the shanks 42 of the hooks 38 are mechanically upset by impact to form flanges 48 thereon. The diameter of the flanges 48 is larger than the diameter of the radially directed apertures 47 in the sleeves 46.

The crook 40 of each hook 3 is threaded through the aperture 47 in the steel strip so that the upper surface of the flange 48 thereof bears against the structure of the metal strip forming the tubular sleeve 46. The flange 48 and metal strip are then moved atop the cross member 30 and the metal strip is arcuately bent around the metal cross member 30 until its edges remote from the hook 38 reside in overlapping fashion, as illustrated in FIG. 2.

With the hooks 38 attached to the cross member 30 as illustrated in FIGS. 1–2 the upper portion 18 of the rigid garment bag frame is suspended beneath the clothes rod 36 by means of the hooks 38. The free ends of the crooks 40 are maneuvered through the openings 44 so that the crooks 40 of the hooks 38 extend upwardly above the top of the covering top 16. The crooks 40 are then hooked over the clothes rod 36. The weight of the metal frame of the garment bag 10 as well as the weight of the garment bag covering 12 is carried by the hooks 38 and by the tubular sleeves 46

The hanging garment bag 10 also includes a garment rod 50 which extends linearly in an undulating fashion to create separations between adjacent hangers 14, but the garment rod 50 is generally parallel to and resides beneath the cross member 30. The ends 52 of the garment rod 50 are turned upwardly and bent into eyes which capture the cross member 30. The garment rod 50 thereby hangs suspended and is attached directly to the cross member 30 of the upper frame portion 18.

From FIGS. 1 and 2 it can be seen that all of the weight of the garments on the hangers 14 pulls downwardly on the cross member 30 and on the tubular sleeves 46 to which the hooks 38 are attached. When clothing of a substantial weight is hung from the garment rod 50 it is not uncommon for the overlapping ends of the tubular sleeves 46 to pull apart due to the weight of the clothing acting on the hangers 14. The garment bag 10 must thereupon either be repaired or discarded.

Figure 3:
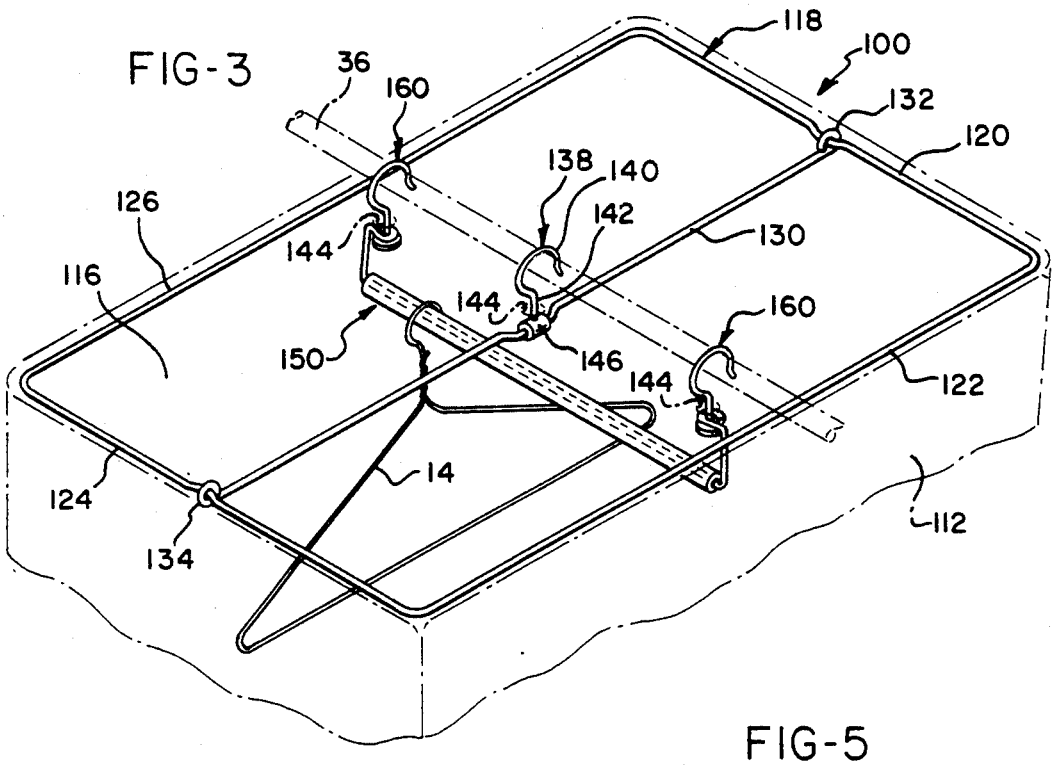
FIG. 3 is a perspective view illustrating the improved hanging garment bag according to the invention.
Figure 4:
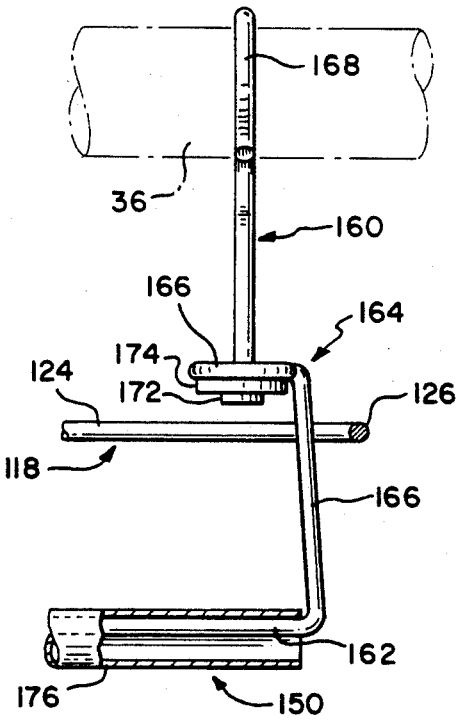
FIG. 4 is a front elevational detail, partially broken away, showing the swivel connection between the garment rod and the garment rod hooks of FIG. 3.
Figure 5:
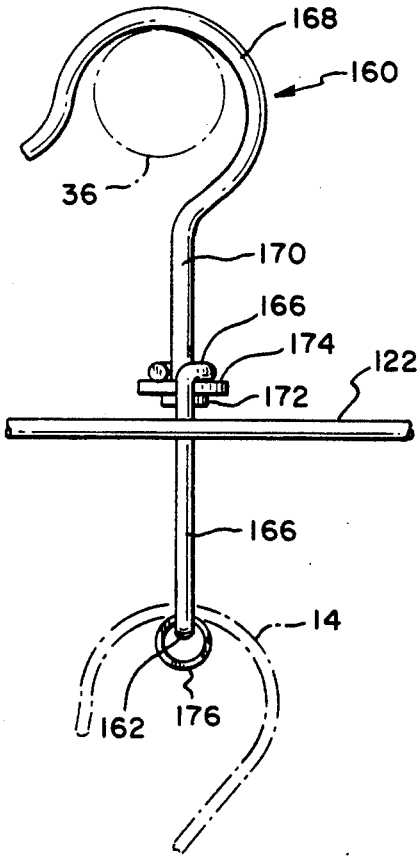
FIG. 5 is a side elevational detail of the garment rod and garment rod hook of FIG. 4.

FIGS. 3–5 illustrate one embodiment of an improved hanging garment bag 100 constructed according to the present invention. The garment bag 100, like the garment bag 10, has a flexible covering 112 that defines an enclosure generally in the shape of a rectangular prism within which garments are hung from a clothes rod 36. The covering 112 has a flat top 116 with a plurality of longitudinally separated apertures 144 defined therein. The apertures 144 are aligned with each other linearly and in a line parallel to the clothes rod 36. The garment bag 100 includes a rigid garment bag frame disposed within the enclosure, the upper portion 118 of which is visible in FIG. 3. The upper garment bag frame portion 118 is formed of steel wire stock about ⅛ of an inch in diameter, which is bent generally into a shape of a rectangle with sides 120, 122, 124 and 126. The opposing short sides 120 and 124 have slight inwardly directed undulations at their centers. A cross member 130 extends between the sides 120 and 124 of the upper frame portion 118. The ends of the cross member 130 are bent over at 132 and 134 to grip the shorter sides 120 and 124 at the center undulations therein.

At the center of the cross member 130 there is an upstanding frame hook 138 that is secured to the rigid upper frame portion 118 and projects upwardly through an opening 144 in the covering 112 for attachment to the clothes rod 36. The upper end of the frame hook 138 forms a crook 140 which passes over the closet clothes rod 36 and the lower end of the hook 138 forms a shank 142 which extends downwardly. The lower extremity of the shank 142 is inserted through a radial opening in a metal strip 146 and is mechanically upset. The metal strip 146 is then wrapped around and tightly grips the cross member 130. Unlike the tubular sleeve 46, the clamping strip 146 does not slide loosely along the cross member 130, but rather is tightly bent to form a clamp that grips the center of the cross member 130.

The rigid frame of the garment bag 100 is constructed with an upper garment bag portion 118 having a wire perimeter formed in a rectangular configuration bisected by the cross connecting intermediate wire support member 130. The frame hook 138 is secured to the frame portion 118 at the center of the intermediate wire support 130. The upper frame portion 118 thereby forms a rectangular loop bisected by the transverse, cross connecting intermediate member 130 which serves as a wire brace. The frame supporting hook 138 is secured to the cross connecting wire brace 130 by a rigid joint formed by the bent metal strip 146.

The improved garment bag 100 of the invention also includes a garment rack indicated generally at 150. The garment rack 150 is used to support garments (not shown) on clothes hangers 14 within the enclosure defined within the covering 112. The garment rack 150 is provided with a pair of garment rack hooks 160 which are coupled to the garment rack 150 and project upwardly through openings 144 in the flat, rectangular top 116 of the covering 112 and are hooked over the clothes rod 36. The garment rack 150 is disposed parallel to the clothes rod 36 with the garment rack hooks 160 projecting up through the longitudinally separated apertures 144 in the covering top 116, proximate the longer sides 122 and 126 of the upper frame portion 118.

The frame hook 138 projects upwardly through another, centrally located aperture 144 in the top 116 of the covering 112. The aperture 144 through which the frame hook 138 projects is located between the garment rack hooks 160. The garment rack 150 is thereby suspended directly from the clothes rod 36, independently of the rigid frame of the garment bag 100, the upper portion 118 of which is illustrated in FIG. 3. To the contrary, the upper frame portion 118 and garment bag covering 118 are suspended from the hook 138, while the garment rack 150 is suspended from the hooks 160, but not from any portion of the garment bag frame.

As best show in FIGS. 4 and 5 the garment rack 150 is comprised of a rod 162 that extends linearly and has a pair of swivel connections 164 at the ends thereof. The garment rack hooks 160 are coupled to the garment rack 150 by means of the swivel connections 164.

The garment rack rod 162 is constructed of heavier steel wire stock than the wire stock forming the sides 120, 122, 124 and 126 of the upper frame portion 118. Specifically, the wire forming the rod 162 is preferably steel wire about 5/32 of an inch in diameter. The central portion of the rod 162 is held horizontally about two inches below the upper frame portion 118 within the enclosure of the garment bag 100. This provides clearance for the hooks of the clothes hangers 14 so that the hangers 14 may be easily placed onto and removed from the garment rod 162. The ends of the linear rod 162 are bent upwardly at 166. The upper extremities of the ends 166 of the rod 162 are bent to form eyes 166 which are disposed in a horizontal plane as illustrated in FIGS. 4 and 5. The eyes 166 are located above the top 116 of the flexible covering 112.

The garment hooks 160 are both formed with crooks 168 at their upper ends for engaging the clothes rod 36. The lower ends of the hooks 138 are formed as shanks 170 which pass through the loops 166 formed at the extremities of the ends 166 of the rod 162. The lower extremities of the shanks 170 are mechanically upset to define disc-shaped flanges 172. Annular steel washers 174 may be threaded onto the tips of the crooks 168 and down the shanks 170 to provide a greater bearing surface before threading the crooks 168 of the garment hooks 160 through the loops 166.

It can be seen that because the shanks 170 fit loosely through the eyes 166 and because the shanks 170 can move longitudinally relative to the loops 166, swivel connections 164 are formed between the garment hooks 160 and the linear garment rack rod 162. The garment rack 150 also includes a tubular polyvinyl chloride plastic sleeve 176 which is disposed loosely about the stiff wire rod 162.

The garment rod hooks 160, the rigid garment bag frame including the upper frame portion 118 and the frame hook 138 are all constructed of stiff, steel wire. However, the wire forming the upper frame portion 118 can be lighter in weight than is possible in a conventional, prior art garment bag, such as the hanging garment bag 10 depicted in FIG. 1 because the rigid garment bag frame of the garment bag 100 does not carry the weight of garments on the hangers 14. Quite to the contrary, the wire forming the linearly extending rod 162 and the garment hooks 160 is typically of a larger diameter than the wire forming the frame portion 118. Thus, the garment rack 150 can be constructed of a heavy gauge wire rod which will withstand the weight of very heavy garments. The wire frame for the garment bag 100, on the other hand, can be a lightweight structure, since it need only support its own weight and the weight of the flexible covering 112.

The principal advantage of the improved garment storage bag 100 is that the garment rack 150 that supports garments hanging on clothes hangers 14 is suspended directly from the clothes rod 36. The weight of the garments therefore does not bear down on any portion of the garment bag frame nor on any portion of the garment bag cover 112. The cover 112 and the garment bag frame are thereby subjected to far less stress than is the case with conventional garment bags, as is evident from a comparison of a typical prior art structure of FIGS. 1 and 2 with the embodiment of the invention depicted in FIGS. 3-5.

Another advantage of the invention is that even if the garment rack 150 becomes bent, due to overloading, the garment rack 150 and garment rod hooks 160 can be replaced without requiring replacement of the flexible covering 112 and rigid frame of the garment bag 100. Also, depending upon the expected use of the garment bag, the garment bag 100 can be provided with heavier duty or lighter weight garment rods 162 and garment rod hooks 160 with the same covering 112 and garment bag frame. The same covering 112 and garment bag frame can thereby be employed for a wide variety of different usages.

Undoubtedly, numerous variations and modifications of the invention will become readily apparent to those familiar with wardrobe storage devices. Accordingly, the scope of the invention should not be construed as limited to this specific embodiment depicted and described, but rather is defined in the claims appended hereto.

We claim:

1. In a hanging garment bag having a flexible covering that defines an enclosure within which garments are hung from a clothes rod, and including a rigid frame disposed within said enclosure and a frame hook secured to said rigid frame and projecting upwardly through said covering for attachment to said clothes rod, and a garment rack for supporting garments within said enclosure, the improvement comprising a pair of garment rack hooks coupled to said garment rack and projecting upwardly through said covering and hooked over said clothes rod, whereby said garment rack is suspended directly from said clothes rod independently of said rigid frame.

2. A hanging garment bag according to claim 1 wherein said garment rack is comprised of a linearly extending rod having a pair of swivel connections at the ends thereof, whereby said garment rack hooks are coupled to said garment rack by means of said swivel connections.

3. A hanging garment bag according to claim 1 wherein a pair of loops are formed at both ends of said linear rod and said garment rack hooks are both formed with crooks for engaging said clothes rod and shanks which pass through said loops of said garment rack rod and which include enlargements at their lower extremities, whereby said loops and said shanks of said garment rack hooks form swivel connections between said garment rack hooks and said garment rack.

4. A hanging garment bag according to claim 1 further characterized in that said covering has a flat top with a plurality of longitudinally separated apertures defined therein aligned with each other linearly and parallel to said clothes rod, whereby said garment rack is disposed parallel t said clothes rod with said garment rack hooks projecting up through longitudinally separated apertures in said covering top, and said frame hook projects upwardly through another of said apertures in said covering top located between said garment rack hooks.

5. A hanging garment bag according to claim 4 further characterized in that said rigid frame is constructed with an upper portion having a wire loop formed in a rectangular configuration bisected by a cross connecting intermediate wire support and said frame hook is secured to said rigid frame at the center of said intermediate wire support.

6. A garment storage bag comprising a flexible covering for enveloping hanging garment therewithin and having a flat top with openings therethrough to allow passage of hooks that engage a clothes rod, a rigid frame disposed within said covering to support said covering so as to define an enclosure of a predetermined shape, a frame hook secured to said rigid frame and extending through one of said openings in said cover top to thereby hold said frame and said cover suspended from an overhead clothes rod, and a garment rod located within said enclosure and having a pair of garment rod hooks which extend up through other of said openings in said flat top to hang directly on said clothes rod, whereby said rigid frame and said garment rod are suspended from said clothes rack independently of each other.

7. A garment storage bag according to claim 6 wherein said garment rod hooks are coupled to said garment rod by means of swivel connections.

8. A garment storage bag according to claim 7 wherein said garment rod is constructed of stiff wire with a tubular plastic sleeve disposed thereabout, and said garment rod hooks, said rigid frame and said frame hook are also all constructed of stiff wire.

9. A garment storage bag according to claim 8 wherein said rigid frame has an upper portion formed with a closed rectangular hoop bisected by a transverse, intermediate support to which said frame hook is connected.

10. A garment storage bag comprising a flexible cover defining a garment storage enclosure therewithin and having a generally flat top with at least three openings therethrough laterally spaced from each other, a rigid frame within said cover including an upper portion located immediately beneath said top of said cover, a frame supporting hook coupled to said upper portion of said frame and extending up through one of said openings in said cover top to engage a laterally extending clothes rod, a laterally extending garment support rod, and garment rod hooks at both ends of said garment support rod extending up through other of said openings in said top of said cover to engage said clothes rod independently of said rigid frame.

11. A garment storage bag according to claim 10 wherein said garment rod hooks are secured by swivel connections to said garment support rod, and both said garment support rod and said garment rod hooks are comprised of rigid wire.

12. A garment storage bag according to claim 10 wherein said garment support rod is comprised of a tubular plastic sleeve disposed about a stiff linearly extending wire member.

13. A garment storage bag according to claim 10 further comprising swivel connections coupling said garment rod hooks to said garment support rod.

14. A garment storage bag according to claim 13 wherein said upper portion of said rigid frame is comprised of wire formed into a rectangular loop bisected by a cross connecting wire brace, and said frame supporting hook is secured to said cross connecting wire brace.

* * * * *